US005499949A

United States Patent [19]

Heubl

[11] Patent Number: 5,499,949

[45] Date of Patent: Mar. 19, 1996

[54] TEETERING OR ROCKING DEVICE

[76] Inventor: Rainer H. Heubl, Bal der Plizbuche 116, 89075 Ulm, Germany

[21] Appl. No.: 298,280

[22] Filed: Aug. 31, 1994

[51] Int. Cl.[6] ..... A63G 13/08

[52] U.S. Cl. ..... 472/105; 472/135; 297/467; 297/452.21; 297/274

[58] Field of Search ..... 472/95, 103, 104, 472/105, 135; 297/467, 452.24, 452.21, 273, 274; 5/630, 632, 655, 900.5, 900.2; D21/64, 65, 66, 67, 68, 69, 70

[56] References Cited

U.S. PATENT DOCUMENTS

| | | | |
|---|---|---|---|
| 2,613,722 | 10/1952 | Ruppert | 297/467 X |
| 2,804,123 | 8/1957 | Kling . | |
| 3,132,860 | 5/1964 | Nantz | 472/105 |
| 4,093,198 | 6/1978 | Petersen | 472/104 X |
| 4,535,495 | 8/1985 | Oldfield | 5/632 X |
| 5,004,216 | 4/1991 | Boudreau | 472/105 X |
| 5,328,410 | 7/1994 | Amburgey et al. | 472/103 X |

FOREIGN PATENT DOCUMENTS

8814682 U 11/1988 Germany .

*Primary Examiner*—Kien T. Nguyen
*Attorney, Agent, or Firm*—Nixon & Vanderhye

[57] ABSTRACT

In connection with rocking devices used up to now, there was the danger of physiological posture damage because of the essentially seated position of the small child. In accordance with the invention, a teetering or rocking device (1) for small children, particularly for small children of an age between approximately one month to approximately twelve months is provided, having a support (2) for receiving the small child (3) on the surface of which the small child rests prone, and having a support device (4) for suspending the support (2) at such a height (h) from the floor that the feet (14) of the small child can reach the floor. The support (2) is formed from a shell which is ergonomically adapted to the body shape of a prone small child, the support surface (17) for the hands and the head follows the shape of an oval in the front area and approximately continuously tapers towards the back in the direction of the stomach into a rear extension (18). The transition area is embodied to drop off slightly toward the rear and is used as a support surface (19) for the stomach and chest part of the small child (3). The device is used as a prophylactic device in case of posture damage.

16 Claims, 6 Drawing Sheets

TEETERING OR ROCKING DEVICE

FIELD OF THE INVENTION

The invention relates to a teetering or rocking device for small children of an age between approximately one month to approximately twelve months.

BACKGROUND OF THE INVENTION

Rocking devices, in particular for small children, are known from the prior art which are primarily intended to be suspended from the ceiling of a room and have either a simple rocker board (for older children) or a bag-like rocker seat of a textile material. However, the essentially seated position which the small child must assume in the known rocking devices creates problems of a physiological nature, because it is an unnatural position for the small child, in particular those of an age of approximately one month to approximately twelve months, i.e. small children who can not yet stand up by themselves or walk. In some cases this can result in damage to the back or hips of the child. The known rocking devices have the further disadvantage that they only insufficiently take into account the desire to move, which is already present in children at only four weeks of age, because the movement of the small child on its own is not possible without the assistance of another person. In most cases they must be attended by a helper, even if only for reasons of safety.

OBJECT AND SUMMARY OF THE INVENTION

The invention is intended to bring relief here. Its object is to make available a teetering or rocking device for small children which, taking advantage of the desire for movement which is already pronounced in small children, permits an independent rocking motion and wherein physiological damage to the small child, in particular damage to the posture, is prevented.

This object is attained by the teetering or rocking device in accordance with the present invention.

The invention is first based on the idea of moving away from the seated or lying prone position of the child required with rocking devices up to now and to provide a support for receiving the child, on the upper surface of which the small child lies on its stomach. It has been shown, in particular in connection with babies, that the prone position has advantages over the seated or back-resting position in respect to the development of the body and mind of the child. In a prone position the child is in a comfortable and secure position. It observes its surroundings from this position and begins to understand its surroundings because of the inborn desire to move at an early age. The first twelve months in the life of a baby are of decisive importance for its later development, in particular for its motor functions. It is known that there are close correlations between mental and bodily development so that it is possible to exercise an essential influence on the mental development of the baby by means of bodily stimuli. The support for receiving the small child is designed in such a way that the stomach area is still completely placed on the support, while the chest can be slightly raised, so that the small child begins to raise itself up. This position makes it possible for the small child to raise its head and to freely turn it to the right and left. The upper thighs are brought into a bent-spread position in the hip joint by means of a narrow, rounded and body-related design of the support in the area of the pelvis, which promotes the physiological development of the hip joints. In this position the small child can exercise all muscles in the torso without putting a strain on the body. Later damage to the posture, such as a round back and weak posture, which are even mostly promoted by the rocking devices presently available in the trade, are assuredly avoided with the embodiment of the teetering or rocking device of the invention.

Because of the suspension (or placement) of the support at such a height above the floor that the feet of the small child come into contact with the floors the small child will be able to perform rocking motions on its own as a result of the tactile stimulation and the resultant stretching of the knee and hip joints or of a rolling movement of the toes. Experiencing this movement, which makes the small child happy, promotes and trains the stretching actions of the muscles of the torso at an early time. In addition to this, it also is trained in the control of the head and torso as well as equilibrium and coordination, and the posture and movement organs are trained in the prone position without stress on the body and the muscles of the torso the legs and the feet are strengthened. In this way the prerequisites for later sitting, standing and walking are provided in a physiologically correct manner.

Beyond this, the teetering or rocking device for small children in accordance with the invention is suitable for therapy, i.e. in particular for babies with neuro-muscular diseases, infantile scoliosis, cerebral movement disorders, hypotonic movement patters (floppy children), dysplastic hips, posture disorders in the area of the feet, cystic fibrosis and the like. Use is being made in the course of this of the demands made by the teetering or rocking device of the invention on the sense of equilibrium and coordination of the child.

In a particularly preferred embodiment of the invention, the height of the support above the floor can be variably adjusted as a function of the age of the child.

In a structurally preferred embodiment, the support device has a frame which can be set at a fixed height above the floor by means of support legs, wherein the support is suspended on the frame in at least two points via a rope in such a way that the height of the support above the floor can be set by the angle between the rope and the floor. In this case, the frame preferably has the shape of the two legs of an isosceles triangle, on the corners of which the support legs are fastened, wherein for suspending the support the ends of the rope are respectively fastened at front and rear points of the support and the rope is symmetrically suspended from a displaceable suspension point of each leg of the frame in such a way that a rocking motion in a direction parallel to the center axis of the isosceles triangle is made possible. In an advantageous manner the front end of the support points to the base of the isosceles triangle. If furthermore, the frame of the support is open at the base of the isosceles triangle, there is no danger that the small child will hit its head against a part of the teetering or rocking device even during larger rocking motions. In addition, the side of the frame open toward the front eases communication between the small child resting on the support shell and a person standing in front thereof.

The small child will soon learn to use its hands to aid the rocking motion. For this reasons it is advantageous if, the section of each rope which can be reached by the small child has a thickening, approximately the shape of a grip. In this embodiment the teetering or rocking device in accordance with the invention is also suitable for training the muscle groups of the upper extremities of the child.

In a further exemplary embodiment of the invention, the support device has at least one elastic element fastened on the underside of the supports which will be resiliently connected with the floor. This embodiment is particularly suitable for employment outsides for example in a children's playground. In this case one end of the elastic element, for example the end of a suitable helical spring, can be firmly anchored in the ground.

In a further embodiment of the invention, the support device has at least one curved element fastened on the underside of the support. By means of it the teetering or rocking device can be caused to make teetering or rocking motions in the manner of a rocking horse.

The size of the support is not subject to limitations per se and can be of such a value that objects, such as children's toys, can be stored. In this case the front end of the support surface terminates in a rising edge, which prevents the dropping off of the object lying on the support surface even during teetering or rocking motions.

An elastic damping element can be provided in an advantageous manner to limit or damp the teetering or rocking motion of the support.

In the embodiment the support comprises a shell, which has been economically adapted to the body shape of the small child lying prone. Its support surface describes the contours of an oval in the front area for the hands and the head and tapers toward the back toward the stomach part approximately continuously into a rear extension. The transition area has been designed to slightly drop toward the back and is used as a support surface for the stomach and chest area of the small child. Support of the hands and the control of the head movements is made easier by this inclination of the support surface. The leg movements of the small child are not hampered by the smooth transition between the support surface for the hands and the rear extension. Because of the shape of the shell of the teetering or rocking device shown, and incidentally disclosed in all details in the drawing figures, the child lies prone in a physiologically correct posture on the teetering or rocking device. The support surface makes possible sufficient support for the arms and hands and can furthermore be used as a depository for toys and the like. A coordinated movement of legs and arms is not yet present particularly in small children of an age of only a few weeks. Control of the head movements of small children takes place essentially by resting the arms so that the upper body of the small child is raised. On the other hand, if tired, the head of the small child can rest in a natural way on the support surfaced so that the small child can remain on the support surface without problems when in the sleeping position. Reference is made in this connection to the calming effects known per se, of the teetering or rocking motions on small children.

In an advantageous embodiment, the rear extension has a surface which is also essentially horizontal but is located lower than that of the support surface for the hands of the small child.

The support surface preferably steadily rises between the rear extension and the support surface, preferably at an angle of inclination of 23° in respect to the horizontal line.

In an advantageous manner, a lateral border roll is provided in the transition area between the front support surface for the hands and the rear extension, which prevents the small child from the sliding out of the side of the teetering or rocking device.

The back end of the rear extension can also be provided with a raised spot which, for one, assuredly prevents the small child from sliding off toward the rear and also provides a good transfer of force between the leg movement and the teetering or rocking device.

It is per se conceivable that the support shell in the shape shown is immovably placed on the floor in a rigid support or, provided with carrying handles, is used as a carrying device for small children. Besides, use as a safety restraining system in a motor vehicle is conceivable, wherein in that case the support shell is provided with means (not further shown) for guiding and fastening two- or three-point safety belts. In a particularly advantageous embodiment, the underside of the support shell is shaped in such a way that the turned support shell can be used as a seating or resting surface for the small child.

Further details, aspects and advantages of the present invention ensue from the following description, making reference to the drawings.

DETAILED DESCRIPTION

Figure 1:
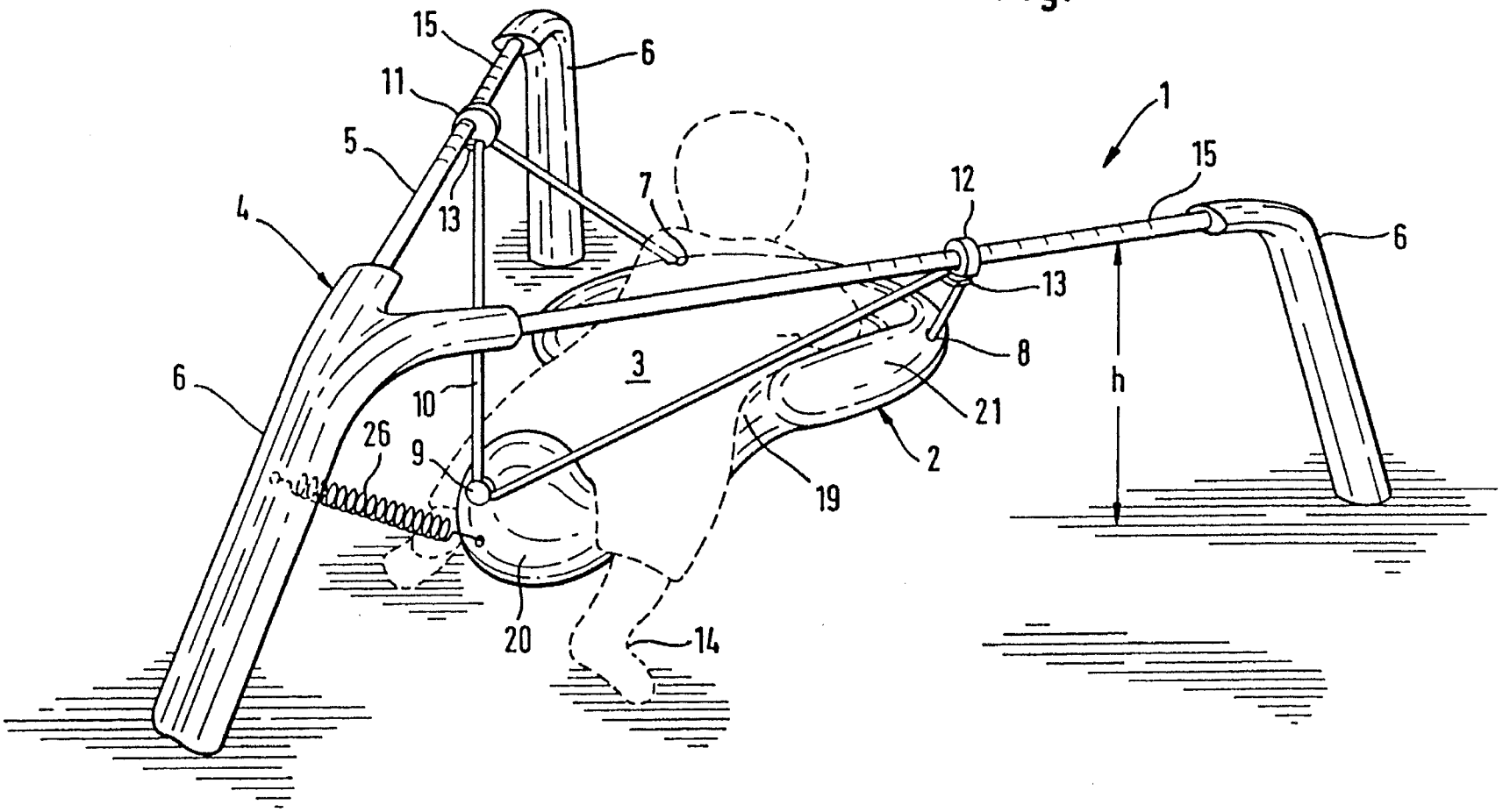
FIG. 1 is a perspective view of a teetering or rocking device in accordance with the invention with a prone child resting thereon indicated.
Figure 2:
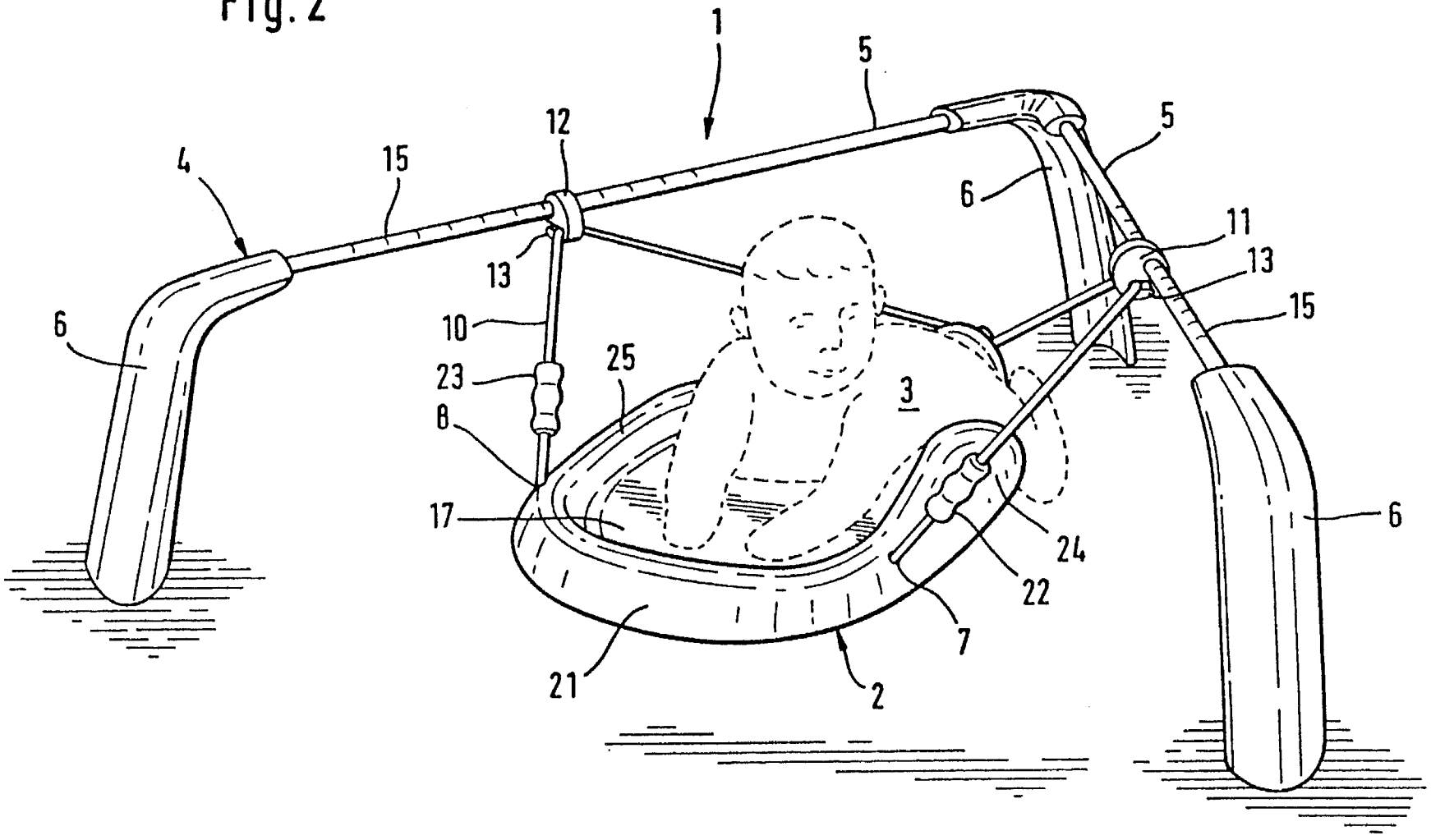
FIG. 2 is a perspective view of the teetering or rocking device.

A teetering or rocking device 1 shown in FIGS. 1 and 2 has a support in the form of a shell 2, on the top of which the small child 3 lies prone. A support device 4 is provided from which the support shell 2 is suspended in such a way than a pendulum-like motion of the support shell 2 is made possible. The support device 4 has a frame 5 formed from two rods, which is placed by means of support legs 6 at a set height h above the floor. The frame 5 therefore has the shape of the two legs of an isosceles triangle open at the side of the base. The support shell 2 is suspended on the frame 5 by means of a rope 10 at three points 7, 8, 9. Adjustment elements 11, 12 are attached to the rods of the frame 5, which have a hook-shaped gripper 13, in which the rope 10 is hung. The height of the support shell 2 above the floor can be set by displacing the adjustment elements 11, 12 on the frame 5 as a function of age of the children in such a way that the feet 14 of the small child 3 can just reach the floor when the support shell 2 is in a position of rest. For an easier setting of the adjustment elements 11, 12 markers 15 can be applied to the frame 5. It is possible to align the support shell 2 in its position of rest in a simple manner parallel to the horizontal line, independently of the set height of the support shell 2 above the floor.

Figure 3:
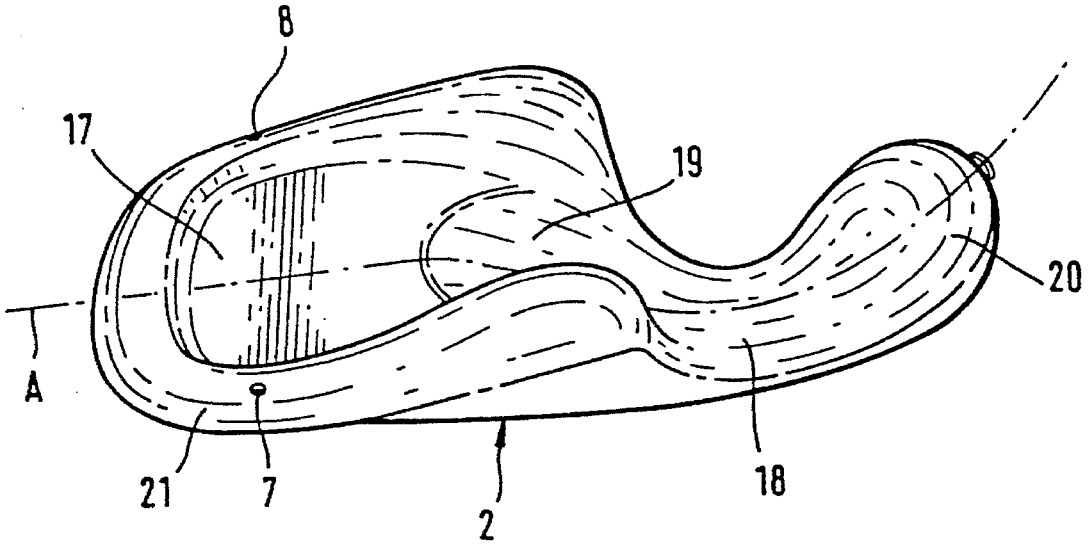
FIG. 3 is a perspective view of a support shell in accordance with the invention.
Figure 4:
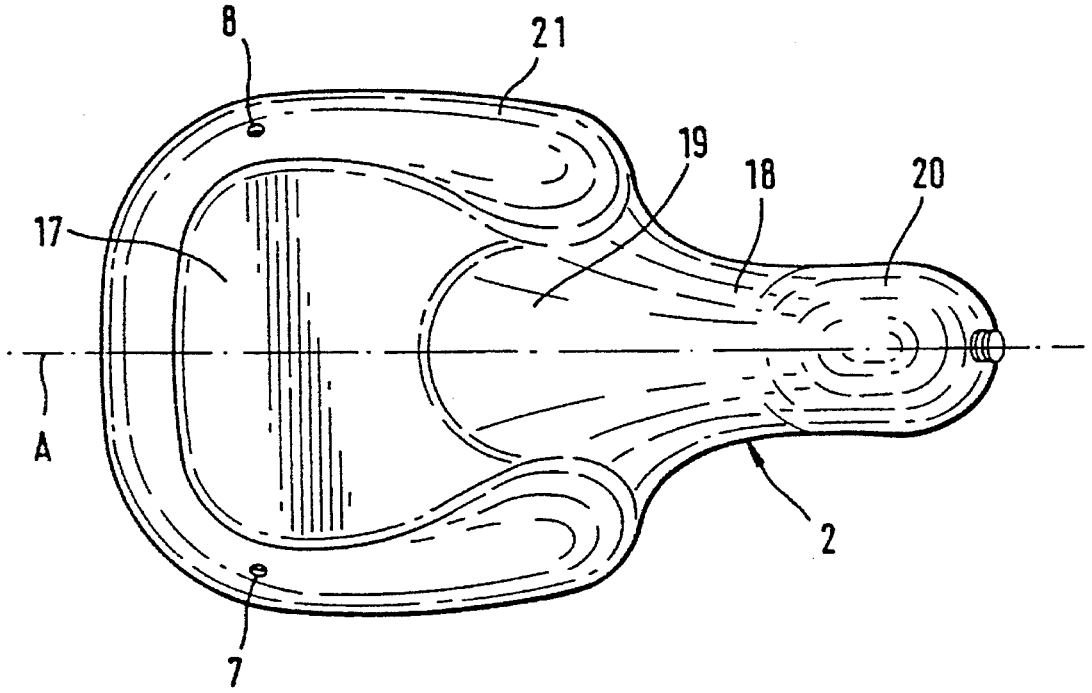
FIG. 4 is a schematic top view of the support shell.

As can be seen from FIGS. 1 and 2, the small child lies prone on the support shell in a physiologically advantageous posture and is secured against sliding and rolling off. Also, when referring to FIGS. 3 and 4, the support shell 2, which preferably is made of plastics has a support surface 17 for the hands of the small child in the front area which, in the position of rests extends horizontally with the surface or slightly inclined toward the front, which follows the contour of an oval, where in this case the large axis of the oval extends perpendicularly to the center long axis of the support shell 2. The back end of the support surface 2 is formed by a small rear extension 18, the surface of which also extends approximately horizontally in the position of rest. However, the surface of this extension is lower than the support surface 17. The support surface 17 and the rear extension 18 are connected with each other by means of a slightly rising and slowly widening support surface 19, the outer contour of which makes a transition into the oval contour of the support surface 17. A raised spot 20 is furthermore provided at the rear end of rear extension 18. The support surface 19 is bordered by upwardly oriented lateral rolls 21 which, at least in parts also extend into the area of the front edge of the support surface 17 and the rear extension 18. It is furthermore possible to provide belts (not shown) for additional securing of the small child.

When the small child lies on the support surface 2, as indicated in FIGS. 1 and 2, the chest and stomach area of the small child is supported by the support surface 19, so that the small child can lift and move its head unrestrained when it puts its hands on the support surface 17. The bottom of the small child rests against the rear raised spot 20 and the legs are placed around the rear extension 18, so that the feet of the small child rest on the floor and that by kicking its legs it can move the support surface forward for executing teetering and rocking motions.

Furthermore, grips 22 and 23 can be seen in FIG .2, which are attached to sections of the rope 10 and which the small child can reach with its hands. In this case the roll 21 can be slightly flattened at the places identified by 24 and 25 (not explicitly shown here), so that the arms of the small child can be supported or put down more comfortably.

Furthermore, a resilient damping element in the shape of a helical spring 26 can be seen in particular in FIG. 1, which is attached at the rear end of the support shell 2 and the support leg 6.

Figure 5:
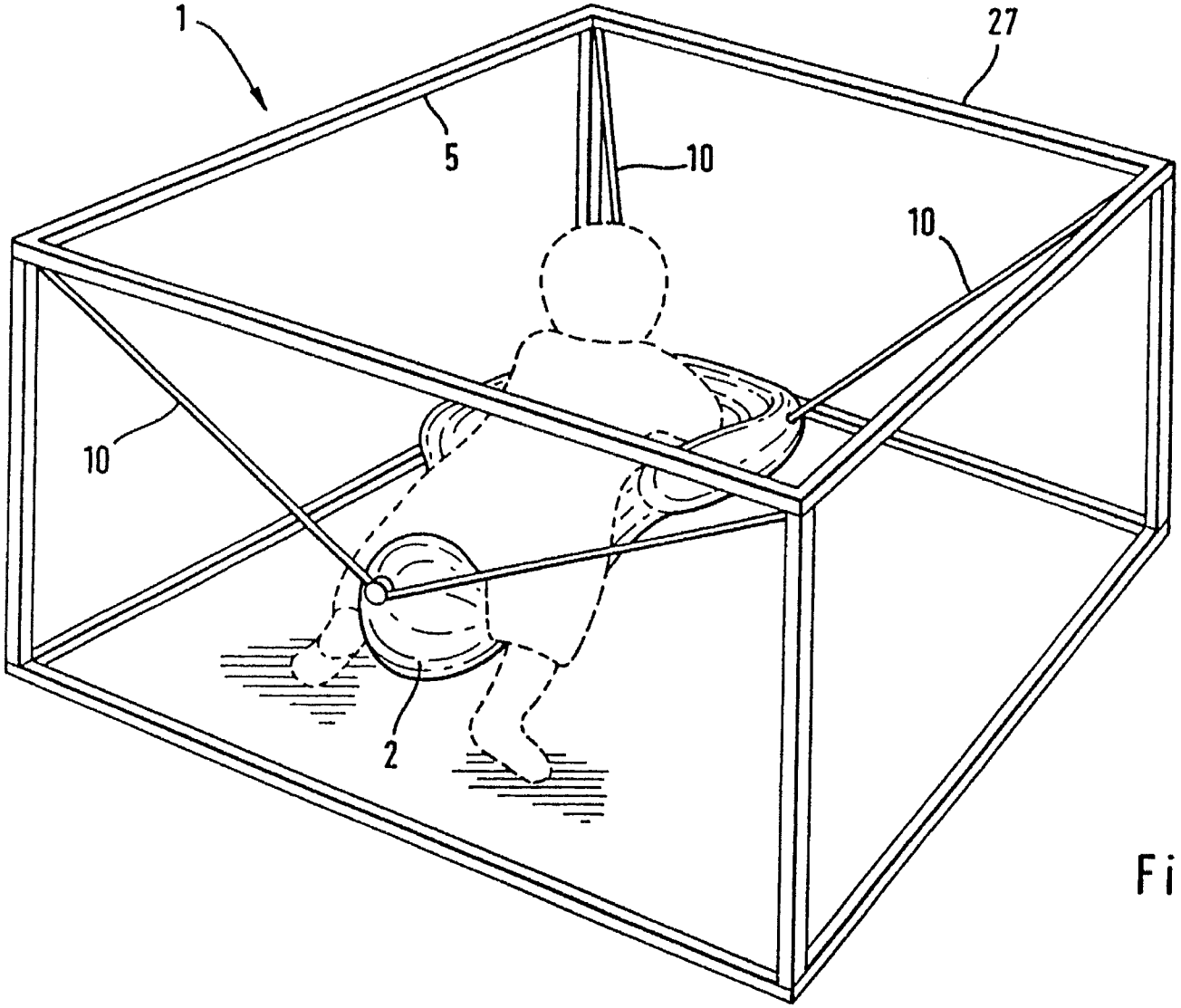
FIG. 5 is a perspective view of a teetering or rocking device in accordance with the invention wherein the support shell is suspended from a children's playpen.

FIG. 5 shows a further exemplary embodiment of a teetering and rocking device 1 of the invention, wherein the support shell 2 is suspended in the manner shown on the upper frame 5 of a generally available playpen 27 by three ropes 10. In this case attachment of the ropes on the frame 5 is performed simply by knotting or by clamps (not further shown). By a simple adjustment of the respective length of the ropes it is possible in a simple manner to set the height of the support shell 2 above the floor and the horizontal orientation of the support shell 2 in the position of rest. The advantage of this exemplary embodiment lies in that a playpen frame, which is often found in households of a family, can be used as the support device 4.

Other support devices (not further shown) of different designs which permit the desired suspension of the support shell 2 are of course also conceivable.

Figure 6:
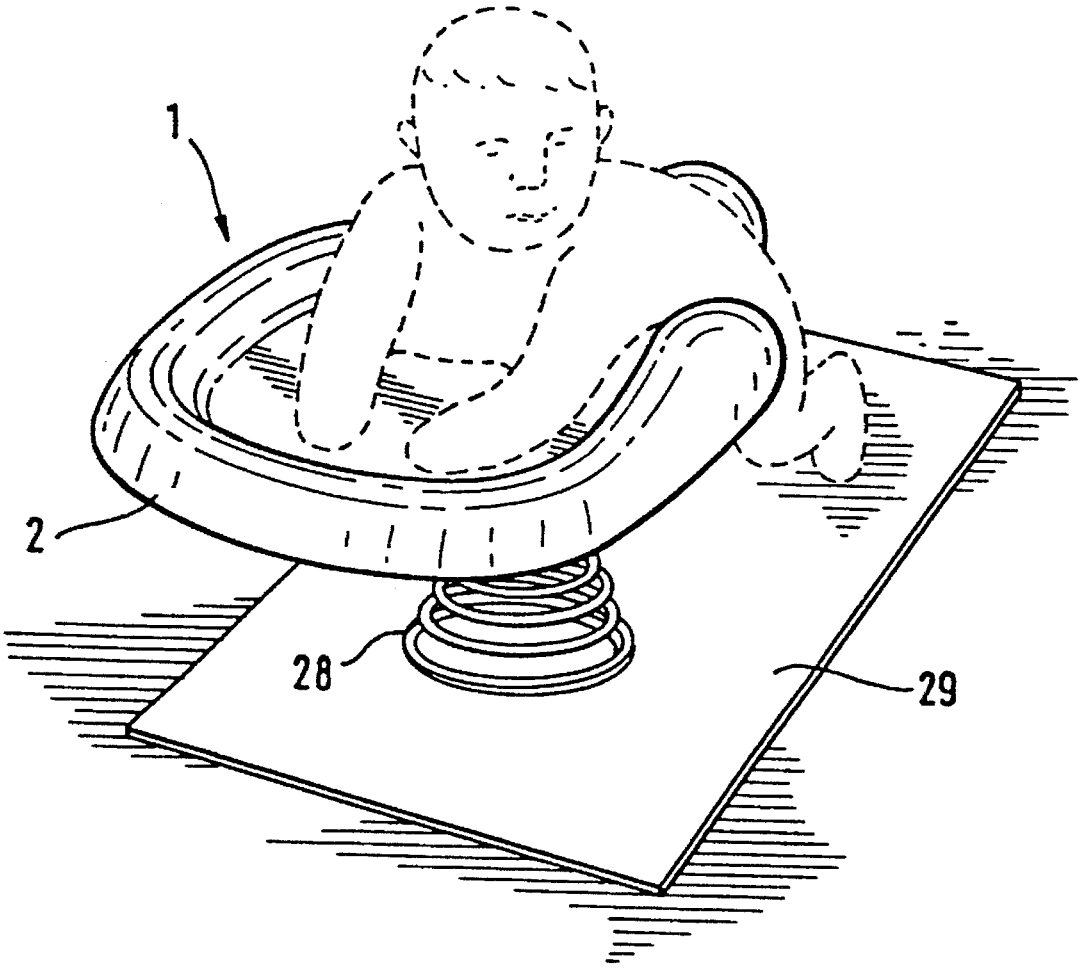
FIG. 6 is a perspective view of a teetering or rocking device in accordance with the invention with a support device in the form of an elastic helical spring; and FIGS. *7a* and *7b* are perspective views of a support shell in accordance with the invention which, when turned over, can be used as a seating or resting surface.

In the embodiment of the invention represented in FIG. 6, the support shell 2 is resiliently supported on the floor by a resilient element 28, wherein in the case illustrated the lower end of the resilient element is fixedly connected with a base plate 29, for example made of metal, which assures a secure placement of the teetering and rocking device 1 on the floor. The base plate 29 has a sufficiently large surface so that the feet of the small child come to rest on the bottom plate 29. When used outside in a playground, in particular, the base plate 29 can be firmly anchored in the ground.

Figure 7A:
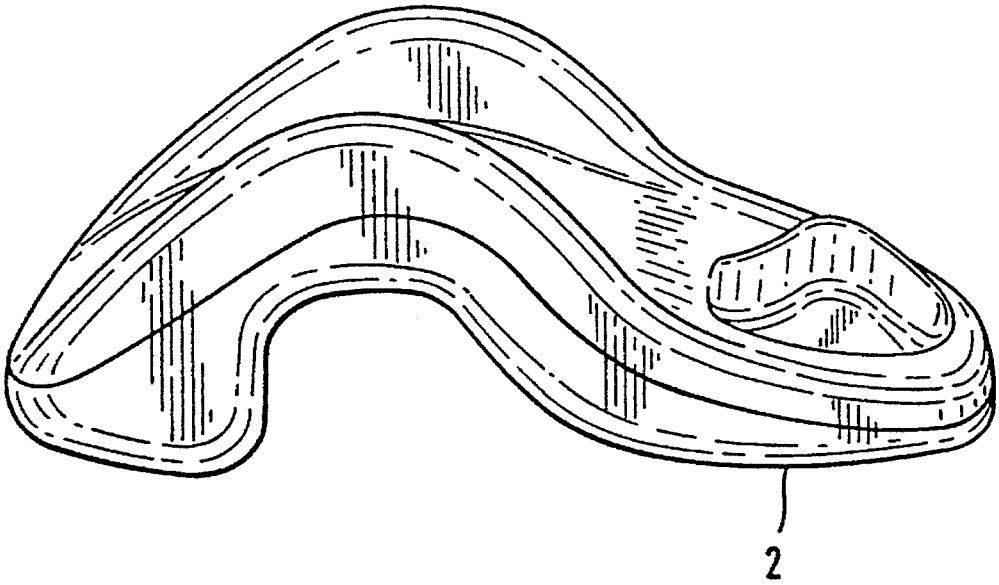
Figure 7B:
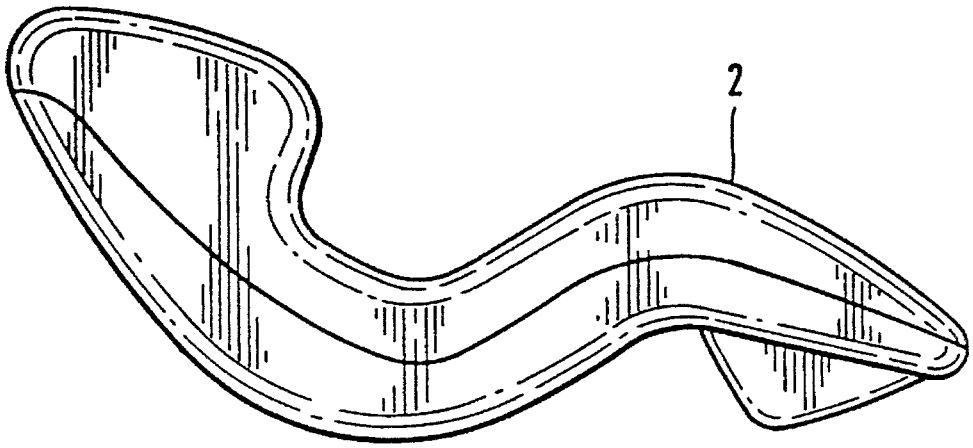

In the embodiments of a support shell 2 of the invention shown in FIGS. 7*a* and 7*b*, its underside is shaped in such a way that the support shell 2, when turned over in accordance with FIG. 7*b*, can be used as a seating or resting surface for the small child. In this special embodiment, the support shell 2 can also be employed for many other uses besides its use as a teetering and rocking device, such as a child's seat in a motor vehicle, as carrying shell for small children, and the like. It is important the the top of the support shell in accordance with FIG. 7*a* assures the illustrated ergonomically advantageous position of the small child in the prone position, so that the stomach area rests fully on the support, while the chest can be slightly raised and the thighs are slightly spread apart in the region of the pelvis. In the representation in accordance with FIG. 7*a*, the small child lies prone in such a way that the head is on the left side of the drawing figure.

A plastic material is preferred as the material for the support shell 2 in accordance with the invention. However, use of another material is not precluded, for example a wood material which is glued together from several layers which have been cut into the shape and pressed together. Also conceivable is its manufacture from a so-called soft foam rubber material which permits compressing the support shell 2 into the smallest space. Manufacture in the form of several welded together foils is also conceivable, so that the support shell 2 can be blown up.

Besides these embodiments as full shapes, embodiments of the support shell 2 are also conceivable, wherein the contour of the support shell is formed by a discontinuous material which is covered with a textile material or where the cover material is placed around it. In this case the support shell can be embodied as a woven structure, for example, of plastic, wire or a natural material, such as wicker (basket material), papyrus, reeds and the like, which is covered by a textile material or any other flat cover. The covering can be easily removable and can be cleaned in a simple manner.

What is claimed is:

1. A teetering or rocking device for a small child, comprising:

a support including a first, substantially flat portion for supporting the child's chest and arms along approximately a horizontal plane, a second portion that gradually slopes down from the first portion at an angle to the horizontal plane having a curved surface shaped to support the child's stomach and pelvis, and a third portion which narrows in width from the second portion to permit the child's upper thighs to wrap around a fourth portion of the support which angles up from the third portion toward the horizontal plane of the first portion; and a support device which permits pendulum-like suspension or support of the support at such a height from the floor that the feet of the child can reach the floor.

2. A teetering or rocking device in accordance with claim 1, wherein the height of the support above the floor can be variably adjusted.

3. A teetering or rocking device in accordance with claim 1, wherein the support device includes a frame set at a fixed height above the floor by support legs and the support is suspended on the frame by connecting a rope from the frame to the support at two or more points, and further comprising means for adjusting an angle between the rope and the floor.

4. A teetering or rocking device in accordance with claim 3, wherein the frame is shaped to include two legs of an isosceles triangle on the corners of which the support legs are fastened, and wherein supporting ends of the rope are respectively fastened at front and rear points of the support and the rope is symmetrically suspended from an adjustable suspension fastening device for adjustably fastening the rope to each leg of the frame to permit a rocking motion in a direction parallel to a center axis of the isosceles triangle.

5. A teetering or rocking device in accordance with claim 4, wherein a front end of the support points to the base of the isosceles triangle.

6. A teetering or rocking device in accordance with claim 4, wherein the frame of the support device is open at the base of the isosceles triangle.

7. A teetering or rocking device in accordance with claim 3, wherein one or more sections of the rope reachable by the small child resting in the support includes a gripping portion which is thicker than the rope for the child to grasp.

8. A teetering or rocking device in accordance with claim 1, wherein the support device has at least one elastic element fastened on an underside of the support which can be fixedly connected with the floor.

9. A teetering or rocking device in accordance with claim 1, wherein a front end of the first portion of the support terminates in a rising edge which prevents dropping off of an object lying on the support surface.

10. A teetering or rocking device in accordance with claim 1, wherein an elastic damping element is connected between the support and the support device to limit or dampen teetering or rocking motion of the support.

11. A teetering or rocking device in accordance with claim 1, wherein the support is shaped like a shell, wherein a front part of the first portion is oval-shaped, and wherein starting at the third portion, the third and second portions continuously widen and make a fluid transition into the oval shape of the first portion.

12. A support shell for use in a teetering or rocking device for a small child, comprising:

a shell including a surface on which the small child lies prone, the shell having a front section which is substantially horizontal and oval-shaped to accommodate the hands and the head of the small child, a rear section lower than the front section which includes a tapered extension area narrower than the front section on either side of which the feet of the small child extend, and a transitional section which continuously widens and rises to make a fluid transition between the narrow extension area and the oval-shaped front section.

13. A support shell in accordance with claim 12, wherein the transitional section steadily rises between the narrow extension area and the substantially horizontal, oval-shaped front section at an angle of inclination of 23 degrees with respect to a line parallel to the substantially horizontal, oval-shaped front section.

14. A shell in accordance with claim 12, wherein the shell includes a peripheral, upward directed border roll.

15. A support shell in accordance with claim 12, wherein the rear section includes a raised portion connected to a rear end of the narrow extension area.

16. A support shell in accordance with claim 12, wherein an underside of the shell is ergonomically contour such that when the shell is turned over, the shell can be used as a seating or resting surface for the small child.

* * * * *